United States Patent [19]

Altman

[11] 4,272,252

[45] Jun. 9, 1981

[54] FIRE LIGHTING DEVICE

[75] Inventor: Donna G. Altman, Atlanta, Ga.

[73] Assignee: Solid Safety, Inc., Atlanta, Ga.

[21] Appl. No.: 36,841

[22] Filed: May 7, 1979

[51] Int. Cl.[3] ..... C10L 11/00; C10L 11/06

[52] U.S. Cl. ..... 44/40; 44/38; 44/41

[58] Field of Search ..... 44/34, 38, 40, 41

[56] References Cited

U.S. PATENT DOCUMENTS

| | | | |
|---|---|---|---|
| 50,503 | 10/1865 | Smith | 44/41 |
| 2,799,563 | 7/1957 | Shenker | 44/40 |
| 3,351,443 | 11/1967 | Gramm et al. | 44/40 |

FOREIGN PATENT DOCUMENTS

| | | | |
|---|---|---|---|
| 22230 | of 1910 | United Kingdom | 44/34 |
| 131446 | 8/1919 | United Kingdom | 44/34 |

*Primary Examiner*—Carl F. Dees

*Attorney, Agent, or Firm*—James B. Middleton

[57] ABSTRACT

A fire lighting device for safety lighting charcoal, wood and other fires. The device includes a mass of cellulosic fibrous material having a flammable substance such as mineral spirits absorbed therein, and the material is sealed within an envelope. The envelope is impervious to the mineral spirits and is burnable, and further includes a layer of polyethylene to attenuate the flame.

7 Claims, 5 Drawing Figures

FIRE LIGHTING DEVICE

FIELD OF THE INVENTION

This invention relates generally to kindling devices for starting fires, and is more particularly concerned with an easily ignitable and slow burning fire lighting device to light a fire safely, yet surely and easily.

BACKGROUND OF THE INVENTION

For many years there has existed a problem in the lighting of a fire in that one may be required to light the fire numerous times before the material for the fire is truly kindled. The most common effort at solving the problem has been the use of easily combustible material such as paper, pine knots, pine cones and the like, the idea being to light the easily combustible material and allow the easily combustible material to kindle the wood, coal or other substance for the fire. The difficulty with this arrangement is that the easily combustible material frequently is totally consumed before the larger pieces of wood or coal are burning well enough to sustain a flame. In this event, one must of course repeat the process, perhaps using a greater quantity of the easily combustible material. It has also be known simply to use a highly flammable substance, such as petroleum product—kerosine, naphtha, etc.—poured on the fire. This of course ignites extremely easily, but it is likely that the material for the fire will not be hot enough to sustain a flame before the petroleum product is consumed. Additionally, the explosive nature of many of the petroleum products renders them very hazardous to use in such fashion.

Another frequently attempted solution to the problem has been to fabricate a brick, tablet, block or the like that will be relatively easy to ignite and will remain burning long enough to light the other material for the fire. These devices have taken numerous forms, frequently including the form of cellulosic material, sometimes impregnated with a flammable substance, and frequently covered in paraffin or other relatively nonvolatile material. The prior art fire starting tablets or blocks have numerous drawbacks, some requiring the inclusion of oxygen yielding compounds to assure a continued burning once ignited, some of the devices will ignite so rapidly as to be dangerous, while some will ignite so slowly as to be difficult to maintain. Also, when one considers fire starting devices in the present day, one must consider the use of charcoal, and the very small blocks or tablets will not produce a sufficiently broad flame to ignite more than one or two charcoal briquettes, resulting in a very time consuming process, or the use of a large number of such tablets.

SUMMARY OF THE INVENTION

The present invention overcomes the above mentioned and other difficulties with the prior art fire lighting devices by providing a mass or block of cellulosic fibrous material having a quantity of flammable liquid absorbed therein, the fibrous material being enclosed within a burnable envelope having flame attenuating means. More specifically, the present invention includes, in one embodiment, rectangular blocks of cellulosic fiber board having a quantity of mineral spirits absorbed therein. The blocks of fiber board are packaged within an envelope and are sealed to prevent the evaporation of the mineral spirits. The envelope is preferably made of cellophane, which has low permeability to the mineral spirits, the cellophane being laminated to a polyethylene sheet which will act to retard the burn rate of the cellophane. In another embodiment, the envelope is filled with loose fibers of the same cellulosic material, and the fibers have a quantity of mineral spirits absorbed therein.

BRIEF DESCRIPTION OF THE DRAWING

These and other features and advantages of the present invention will become apparent from consideration of the following specification when taken in conjunction with the accompanying drawing in which.

DESCRIPTION OF THE EMBODIMENTS OF THE INVENTION

Figure 1:
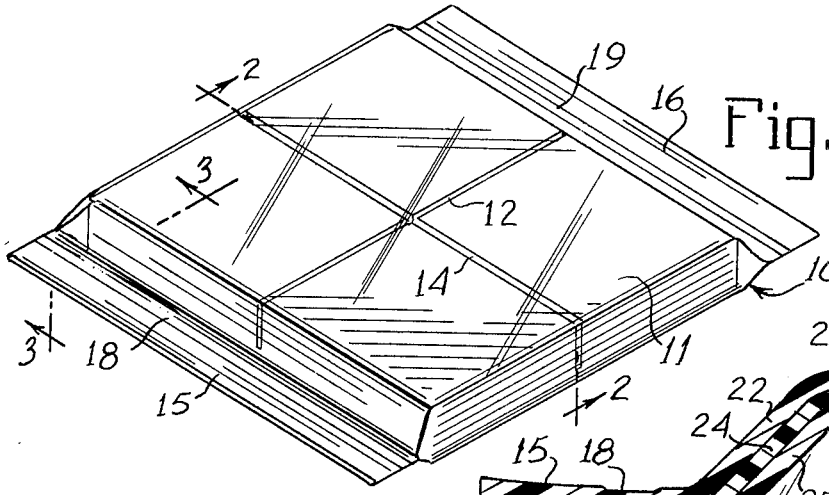
FIG. 1 is a perspective view of a fire lighting device made in accordance with the present invention.

Referring now more particularly to the drawing, and to those embodiments of the invention here chosen by way of illustration, FIG. 1 shows a fire lighting device made in accordance with the present invention and including generally an envelope 10 having a fibrous block 11 therein. It will be seen that the block 11 has a pair of saw cuts 12 and 14 dividing the block into four sections. This block 11 is within the envelope 10, and the material of the envelope is appropriately flattened at each end as at 15 and 16. There is a heat sealed strip 18 and 19 respectively along each of the flattened ends. The block 11, therefore, with the combustible material absorbed therein, is completely sealed in the envelope 10.

Figure 2:
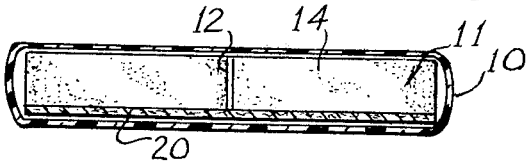
FIG. 2 is a cross-sectional view taken substantially along the line 2—2 in FIG. 1.

Referring now to FIG. 2 of the drawing it will be seen that the block 11 substantially fills the envelope 10. The block 11 does not make a tight fit within the envelope 10, but there is a close enough fit that there is not a lot of extra packaging material. This will be discussed in more detail hereinafter. It will also be seen in FIG. 2 that the saw cuts 12 and 14 do not extend completely through the block 11, but there is a narrow backing strip 20 remaining so that the block 11 is a unitary block. It will be noted, however, that the backing 20 is quite narrow so that the block 11 can be easily broken on any saw cut, such as the saw cuts 12 and 14.

Figure 3:
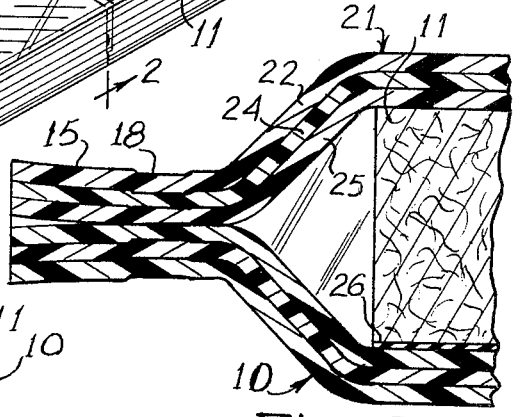
FIG. 3 is a greatly enlarged cross-sectional view taken substantially along the line 3—3 in FIG. 1.

Referring now to FIG. 3 of the drawing it will be seen that, again, there is not a large amount of excess packaging material at the ends of the block 11. Also, it will be seen that the packaging material of the envelope 10 is shown sufficiently large to show the plurality of layers.

Those skilled in the art will realize that other precise materials, and other precise arrangements of materials, may be used, but one packaging material that has been found to carry out the present inventive concept quite admirably is shown in the drawing. As illustrated, the packaging material designated at 21 is made up of three layers 22, 24 and 25. The layers 22 and 25 are the outer layers and are made of cellophane. Those skilled in the art will realize that cellophane is a cellulose derivative and is rather easily flammable. Cellophane will ignite easily and is consumed quite fast. The two sheets 22 and 25 of cellophane sandwich therebetween a layer 24 which is polyethylene. It will be understood that polyethylene is a thermoplastic and melts easily, but it does not sustain a flame. In the material 21 used in the present invention, the cellophane layers 22 and 25 are thermally bonded to, and sandwich therebetween, the polyethylene layer 24, and the polyethylene layer 24 acts as an attenuator for the burning of the cellophane layers 22 and 25. As a result, the packaging material 21 will burn, but will not burn rapidly, the flame spreading across the material at a slow but sure rate.

The material for the block 11 is, as previously stated, a porous block made of cellulosic fibers. While there are numerous such fiber boards readily available, it has been found that a cellulosic fiber insulating board works extremely well in the fire lighting device of the present invention. An insulating board is generally made largely of wood or cane fibers, though it will be realized that other fibers may be used, and the board is porous, having a considerable amount of air within the board. It will be understood that, in the present invention, it is desirable to have a sufficient number of air pockets both to assure that there is oxygen available to sustain the fire, and to retard the transfer of heat to slow the burning process. In general, it has been found that a density of approximately 1 to 2 grams per cubic centimeter provides the desired density and porosity.

It should also be remembered that the combustible material is absorbed into the fibrous board, so if the density is too low there will be insufficient material to absorb the liquid, and much of the desired quantity of liquid may appear as liquid in the envelope 10. This would be quite undesirable since the free liquid would burn quite rapidly and be hazardous for that reason.

While many combustible liquids will produce an acceptable fire lighting device in accordance with the present invention, the most desirable has been found to be mineral spirits, or ligroin. It will be understood that mineral spirits is a petroleum distillate having a density in the general vicinity of 0.85 to 0.87. More particularly, when petroleum is distilled at a pressure of one atmosphere, no less than five percent is recovered at 130° C., an no more than 90 percent is recovered at 145° C. These figures are given by way of example since it will be realized that the distillates of petroleum constitute a continuum, and it will be obvious to those skilled in the art that the distillates recovered on each side of the figures given will work acceptably in the present invention. In any event, it has been found that the mineral spirits as set forth is the preferred material because of its burning rate. Lighter petroleum distillates tend to ignite too rapidly and cause a flash which may be hazardous, while heavier petroleum distillates tend to be somewhat too difficult to ignite.

From the above description, the lighter of the present invention as disclosed in FIGS. 1, 2 and 3 should be understood. One would first take a piece of the board from which the blocks 11 are made, the board preferably being between approximately ½ and 2 centimeters, the preferred dimension being approximately 1¼ centimeters in thickness. This board can then be cut into the individual blocks 11. The size of the blocks 11 can be varied considerably depending on the size of fire to be lighted with the completed fire lighter. It has been found that a rather convenient technique is to make saw cuts such as the saw cuts 12 and 14 approximately 5 centimeters apart, but leaving a small backing sheet 20 rather than cutting completely through the board. After the entire board had been so cut, individual squares can be broken off quite easily in whatever units are desired. As is shown in FIG. 1 of the drawing, there are four of the individual squares, which would make the over all block have dimensions of approximately 10 centimeters square by 1¼ centimeters thick. A fire lighting device of this size is sufficient to light charcoal for a conventional domestic charcoal grill or will ignite wood or the like in a conventional domestic fireplace. Obviously, the block 11 could be as small as one of the units, or about 5 centimeters square, which may be desirable for lighting charcoal in a hibachi or the like.

After the block 11 has been cut from the fiber board, a quantity of mineral spirits would be placed on the block to be absorbed thereinto. The quantity of mineral spirits for a block such as the block 11 can be varied somewhat, generally from around 15 ml. to approximately 30 ml. It has been found that the preferred quantity of mineral spirits for the block as discussed in connection with FIG. 1 of the drawing is 20 ml. Such a quantity of mineral spirits in a block this size has been found to ignite easily and produce the relatively slow, uniform burn that is safe, but it burns a sufficient length of time to ignite charcoal or other substances.

After the mineral spirits has been absorbed into the block 11, the block 11 will be placed into the envelope 10, and the ends 15 and 16 of the envelope 10 will be heat sealed as along the lines 18 and 19.

While a fire lighting device as shown in FIG. 1 will in fact burn almost immediately after the device has been assembled, it has been found that the device improves somewhat with time. While the mineral spirits is absorbed into the block 11 rather fast, it will be readily understood that the mineral spirits will tend to be in a small area when first applied; however, after the fire lighter has been assembled for a period of time, the mineral spirits disperses throughout the block 11 evenly due to the natural wick action and capillary action of the liquid within the porous block. As mineral spirits is also volatile, it will be understood that the mineral spirits will tend to evaporate from the block so that the envelope 10 will be filled with vapor. Since the envelope 10 is impervious to the mineral spirit vapor, the vapor and the liquid absorbed in the block 11 will reach a state of equilibrium. Once this state of equilibrium has been reached, it will be understood that the vapor will be free within the envelope 10 so that the escaping vapor will assist in igniting the fire lighting device once the envelope is opened by the fire.

The lack of excess packaging material has been previously referred to, and one reason for the frugality of the packaging material is that a very large air space within the envelope would deprive the block 11 of much of the mineral spirits to reduce the burnability of the block, or require a greater quantity of mineral spirits. If the larger quantity of mineral spirits were used, there would be a large amount of vapor at the time of lighting the fire which could cause a flare-up. This may be hazardous. Additionally, it has been found that, if an excessively large amount of packaging material extends beyond the block 11, a user tends to pile charcoal briquettes or other fuel on the packaging material so that a flame might not be sustained from the outermost edge of the packaging material to the portion of the material that includes the block 11. For both these reasons, it will be understood that the envelope 10 should be of a just sufficient size as shown in the drawing.

Commercially, the fibrous insulating board above referred to is available with an asphalt coating on one side thereof, and this board is highly satisfactory for making the fire lighter of the present invention. The asphalt coating of course is not required to practice the invention, but there is a contribution by the asphalt.

First, the asphalt coating will act as a barrier for the mineral spirits, limiting the migration of the mineral spirits through the one surface of the block 11. Additionally asphalt is a heavy petroleum product and, once ignited, it will burn slowly and steadily. As a result, the asphalt may somewhat extend the burning time of the fire lighter.

It will be understood that the asphalt, in liquid form, would be placed on the fibrous material after the material has been made into a sheet. Thus, the asphalt will be absorbed into the material, though to a small extent due to its high viscosity. The external coating may be very thin, in the vicinity of 0.2 to 0.5 mm, and even including the absorption into the fiber board, the asphalt may cover one milimeter or less. In view of this, the drawing, in FIG. 3 thereof, shows a thin section 26 representing the asphalt coating.

As an added feature to the device shown in FIGS. 1, 2 and 3 of the drawing, it has been found that the block 11 can be easily colored by conventional dyes. Since the block 1 is made of cellulosic material, it will be understood that conventional fabric dyes work quite will and any desired color can be chosen.

Figure 4:
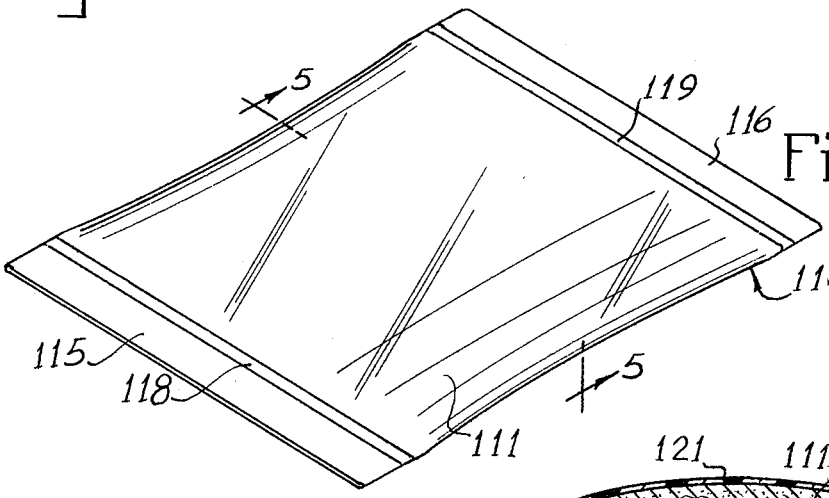
FIG. 4 is a perspective view of a modified form of the fire lighting device of the present invention; and, FIG. 5 is a cross-sectional view taken substantially along the line 5—5 in FIG. 4.
Figure 5:
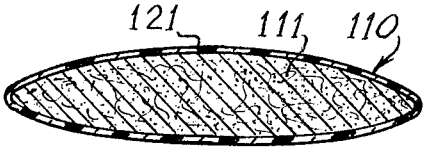

Referring now to the embodiment of the invention shown in FIGS. 4 and 5 of the drawing, it will be seen that the device includes the envelope 110 having ends 115 and 116 with heat sealed strips 118 and 119. It should be understood that the packaging material 121 is the same material as described in conjunction with FIG. 3 of the drawing, but the device shown in FIG. 5 is drawn on a sufficiently small scale that the three layers of material are not illustrated.

Rather than the block 11, the embodiment of the invention shown in FIGS. 4 and 5 of the drawing has a mass 111 which conforms to the shape of the interior of the envelope 110. The mass 111 is formed by using, effectively, sawdust from the boards from which the blocks 11 were cut. Again, it should be understood that virtually any fibrous material of a cellulosic nature will perform quite well. This loose sawdust is simply poured into a bag, and mineral spirits is placed into the bag to be absorbed within the mass 111. It has been found that, with a bag measuring approximately 10 by 12 cm. and containing approximately 20 g. of fibrous material, approximately 25 ml. of mineral spirits will yield the desired lighting characteristics. Approximately 15 ml. to about 55 ml. of mineral spirits will perform acceptably, but the 25 ml. quantity is the preferred quantity, giving the most desirable results for the present invention. The density of the fibrous material in this example will be around 0.2 g. per cubic centimeter. In general, the density will be from about 0.1 to about 0.5 g. per cubic centimeter.

It will be seen that there is no vacant air space in the envelope 110, so there is no mineral spirits vapor within the envelope 110. Otherwise the embodiment of the invention shown in FIGS. 4 and 5 of the drawing is similar to the embodiment of the invention disclosed in conjunction with FIGS. 1, 2 and 3 of the drawing. One important difference is the surprising fact that the mineral spirits tends to cause the material 111 to have a cohesiveness so that, when the device is used the material 111 does not flow like a powdery substance even though the evelope 110 is burned sufficiently to allow the material 111 to escape. Because of this surprising fact, the embodiment of the invention shown in FIGS. 4 and 5 of the drawing can be used in open gates and the like to build fires, creating neither the hazardous situation of having burning material spread where not wanted nor the undesirable feature of losing the igniting fire from amidst the material to be burned.

It will therefore be seen that the fire lighting device of the present invention is extremely inexpensive to manufacture both from the standpoint of the cost of materials and from the standpoint of the labor involved in assembling the device. Once the device is totally assembled, it can be easily handled without danger since the cellophane on the outside of the envelope is not toxic and does not react readily with most chemicals found in a normal household. The devices can therefore be stored conveniently for use when needed. Additionally, it will be understood that the cellophane of the envelope 110 can be printed by conventional techniques so that all advertising material, instructions, and any necessary warnings can be printed directly on the fire lighter itself.

It will of course be understood by those skilled in the art that the particular embodiments of the invention here presented are by way of illustration only and are meant to be in no way restrictive; therefore, numerous changes and modifications may be made, and the full use of equivalents resorted to without departing from the spirit or scope of the invention as defined in the appended claims.

I claim:

1. A fire lighting device comprising a cellulosic fibrous material having a combustible volatile petroleum distillate absorbed therein, said fibrous material being porous and having air contained therein, said fibrous material having a density of approximately one to two grams per cubic centimeter, a burnable envelope, said fibrous material with said petroleum distillate absorbed therein being sealed within said burnable envelope and substantially filling said envelope, said burnable envelope being impervious to vapors of said petroleum distillate, said envelope comprising a plurality of layers of material, at least one of said plurality of layers of material being cellophane for providing an easily burnable quality to said burnable envelope, and one layer of said plurality of layers of material being polyethylene for retarding the burning of said burnable envelope.

2. A fire lighting device as claimed in claim 1, characterized in that said fibrous material comprises a block of fiber board.

3. A fire lighting device as claimed in claim 2, characterized in that said petroleum distillate is mineral spirits.

4. A fire lighting device as claimed in claim 1, characterized in that said fibrous material comprises a mass of cellulosic fibers packed into said envelope.

5. A fire lighting device as claimed in claim 3, characterized in that the quantity of mineral spirits absorbed in said block is within the range of from 15 to 30 ml. of mineral spirits for a block measuring approximately 10 cm. square by $1\frac{1}{4}$ cm. thick.

6. A fire lighting device as claimed in claim 3, characterized by a burnable vapor barrier coating on one side of said block.

7. A fire lighting device as claimed in claim 6, characterized in that said coating consists of asphalt.

* * * * *